US008592709B2

(12) United States Patent
Newase et al.

(10) Patent No.: US 8,592,709 B2
(45) Date of Patent: Nov. 26, 2013

(54) CURRENT PATH ARRANGEMENT FOR A CIRCUIT BREAKER

(75) Inventors: Yatin Vilas Newase, Maharashtra (IN); Janakiraman Narayanan, Andra Pradesh (IN); Soundararajan Narayanasamy, Hyderabad (IN); Sachin Kurkure, Andhra Pradesh (IN); Mahesh Jaywant Rane, Secunderabad (IN)

(73) Assignee: General Electric Company, Schenectady, NY (US)

( * ) Notice: Subject to any disclaimer, the term of this patent is extended or adjusted under 35 U.S.C. 154(b) by 953 days.

(21) Appl. No.: 12/103,109

(22) Filed: Apr. 15, 2008

(65) Prior Publication Data

US 2009/0256658 A1 Oct. 15, 2009

(51) Int. Cl.
*H01H 33/02* (2006.01)

(52) U.S. Cl.
USPC ..... 218/156; 218/154

(58) Field of Classification Search
USPC ..... 218/15, 34–40, 44, 46, 149–157; 335/16, 201, 202
See application file for complete search history.

(56) References Cited

U.S. PATENT DOCUMENTS

| | | | | |
|---|---|---|---|---|
| 3,296,402 | A * | 1/1967 | Meinders | 218/37 |
| 4,649,247 | A * | 3/1987 | Preuss et al. | 200/244 |
| 4,884,047 | A | 11/1989 | Baginski et al. | |
| 4,958,135 | A * | 9/1990 | Baginski et al. | 335/8 |
| 4,982,174 | A | 1/1991 | Fasano | |
| 5,164,693 | A | 11/1992 | Yokoyama et al. | |
| 5,258,733 | A | 11/1993 | Link et al. | |
| 5,278,531 | A | 1/1994 | Link et al. | |
| 5,298,874 | A | 3/1994 | Morel et al. | |
| 5,317,117 | A | 5/1994 | Bruski et al. | |
| 5,341,191 | A | 8/1994 | Crookston et al. | |
| 5,493,092 | A | 2/1996 | Rowe | |
| 5,945,650 | A | 8/1999 | Holland et al. | |
| 6,232,570 | B1 | 5/2001 | Castonguay et al. | |
| 6,248,971 | B1 | 6/2001 | Morel et al. | |
| 6,317,019 | B1 | 11/2001 | Herpin et al. | |
| 6,407,354 | B1 | 6/2002 | Turner et al. | |
| 6,479,781 | B1 | 11/2002 | Bagepalli et al. | |
| 6,573,815 | B1 | 6/2003 | Tsukima et al. | |
| 6,917,269 | B2 | 7/2005 | Bach et al. | |
| 6,919,785 | B2 * | 7/2005 | Douville et al. | 335/172 |
| 6,930,573 | B2 * | 8/2005 | Ciarcia et al. | 335/8 |
| 7,189,935 | B1 | 3/2007 | Hassan et al. | |

FOREIGN PATENT DOCUMENTS

| | | | |
|---|---|---|---|
| CN | 1235364 | A | 11/1999 |
| DE | 3515158 | A1 | 11/1986 |
| EP | 0392836 | A2 | 10/1990 |
| EP | 437151 | B1 | 11/1990 |

(Continued)

OTHER PUBLICATIONS

EP 09157330.3—2214/2110838 Search Report and Written Opinion, May 31, 2010.

(Continued)

*Primary Examiner* — Amy Cohen Johnson
*Assistant Examiner* — Marina Fishman
(74) *Attorney, Agent, or Firm* — Global Patent Operation; Stephen G. Midgley

(57) ABSTRACT

An apparatus includes an enclosure, a plurality of circuit breaker sub poles, each enclosed within a chamber of the enclosure, and a plurality of arc chutes, each installed on one of the chambers enclosing the circuit breaker sub poles.

15 Claims, 8 Drawing Sheets

(56) References Cited

FOREIGN PATENT DOCUMENTS

| | | | |
|---|---|---|---|
| EP | 0961306 | A2 | 12/1999 |
| GB | 2286486 | A | 8/1995 |
| WO | 9520237 | A1 | 7/1995 |
| WO | WO02075760 | A1 | 9/2002 |

OTHER PUBLICATIONS

Search Report from corresponding CN Application No. 200910136872.X dated Nov. 29, 2012.

* cited by examiner

CURRENT PATH ARRANGEMENT FOR A CIRCUIT BREAKER

BACKGROUND

The disclosed embodiments relate to circuit breaker current paths for providing additional current capability.

Circuit breakers are generally implemented to protect equipment from overcurrent situations, for example, when a short circuit or ground fault occurs in an electrical supply conductor. Upon the occurrence of an overcurrent condition, electrical contacts within the circuit breaker will generally open, stopping the supply of electrical current to the equipment. Designs for circuit breakers generally include accommodations for both high quiescent currents and high withstand currents. To maintain a high withstand current rating, the contacts must be locked closed at the current withstand rating and be able to withstand the large electrodynamic repulsion forces generated by the current flow.

Multipole circuit breakers include a variety of construction implementations such as blow open and non-blow open contact arms, overcentering and non-overcentering contact arms, single contact pair arrangements with the contact pair at one end of a contact arm and a pivot at the other end thereof, double contact pair arrangements, sometimes referred to as rotary breakers, with a contact pair at each end of a contact arm and a contact arm pivot intermediate or centrally located between the two ends, and single housing constructions with the circuit breaker components housed within a single case and cover. Other implementations include cassette type constructions with the current carrying components of each phase housed within a phase cassette and each phase cassette housed within a case and cover that also houses an operating mechanism.

Multipole circuit breakers are generally available in two, three, and four pole arrangements, with the two and three pole arrangements generally used in two and three phase circuits, respectively. Four pole arrangements are typically employed on three phase circuits having switching neutrals, where the fourth pole operates to open and close the neutral circuit in a coordinated arrangement with the opening and closing of the primary circuit phases.

Generally, each pole in a multiphase circuit breaker system is provided with a current sensing element that generates a trip signal which is used to trip the circuit breaker. Each pole may carry a significant amount of current. FIG. 1 shows a diagram of an exemplary circuit breaker 100 for a single phase. Breaker 100 includes a fixed contact assembly 105 and a movable contact assembly 110 that pivots about a rotation point 140. The movable contact assembly 110 may include one or more first arcing contacts 120 and one or more first main contacts 125 mounted on one or more finger assemblies 145.

The one or more finger assemblies 145 may operate to provide a mounting point for the one or more first arcing contacts 120 and one or more first main contacts and to provide a conduction path between the arcing and main contacts and a movable assembly load terminal 150. The one or more finger assemblies 145 may be resilient to allow the finger assemblies to pivot about a pivot point 115. The one or more finger assemblies 145 may also provide a spring force to assist in opening the circuit breaker contacts with a desired velocity upon an overcurrent occurrence.

The fixed contact assembly 105 may include one or more second arcing contacts 130 and one or more second main contacts 135. The fixed contact assembly 105 may also include a fixed assembly load terminal 155 on which the one or more second arcing contacts 130 and one or more second main contacts 135 may be mounted. The fixed and movable contact assemblies 105, 110 are generally constructed to withstand closing on a fault and thus have a significant current carrying capability.

It would be advantageous to provide a circuit breaker system with an increased current carrying capability.

BRIEF DESCRIPTION OF THE DISCLOSED EMBODIMENTS

The following are non limiting exemplary embodiments.

In one embodiment, an apparatus includes an enclosure, a plurality of circuit breaker sub poles, each enclosed within a chamber of the enclosure, and a plurality of arc chutes, each installed on one of the chambers enclosing the circuit breaker sub poles.

In at least one other embodiment, a method includes providing a plurality of circuit breaker sub poles, each enclosed within a chamber of an enclosure, and installing an arc chute on each of the enclosures.

BRIEF DESCRIPTION OF THE DRAWINGS

The foregoing aspects and other features of the presently disclosed embodiments are explained in the following description, taken in connection with the accompanying drawings, wherein.

DETAILED DESCRIPTION

Figure 1:
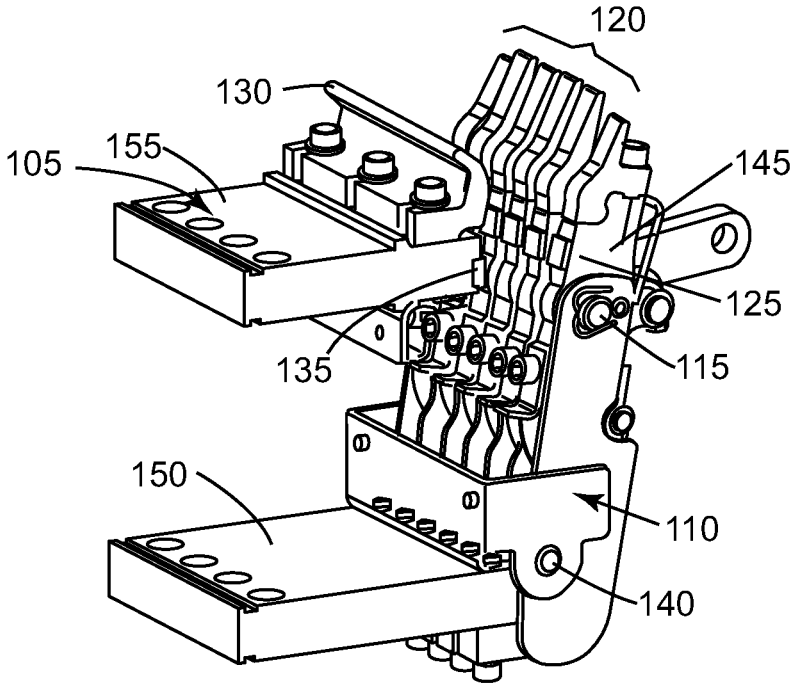
FIG. 1 Prior Art
FIG. 1 shows a diagram of an exemplary circuit breaker.
Figure 2A:
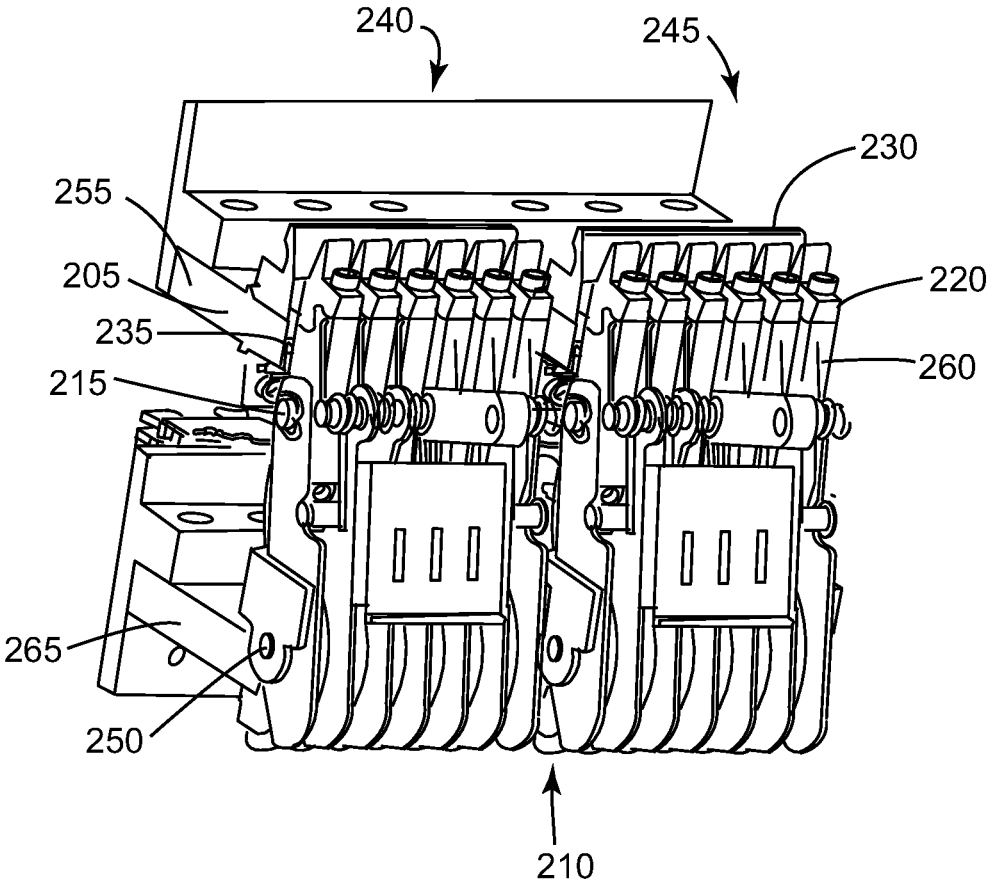
FIG. 2A shows an exemplary circuit breaker suitable for practicing the disclosed embodiments.

FIG. 2A shows an exemplary circuit breaker 200 suitable for practicing the embodiments disclosed herein. Although the presently disclosed embodiments will be described with reference to the drawings, it should be understood that they may be embodied in many alternate forms. It should also be understood that In addition, any suitable size, shape or type of elements or materials may be used.

The disclosed embodiments are generally directed to a circuit breaker system with an increased current carrying capability. Other embodiments may include a modular arrangement of sub poles for each pole and individual arc chambers for each sub pole.

Circuit breaker 200 may include a fixed contact assembly 205 and a movable contact assembly 210 that pivots about a rotation point 250. The movable contact assembly 210 may generally include one or more first arcing contacts 220 and one or more first main contacts 225 (FIG. 2B) mounted on one or more finger assemblies 260. The one or more finger assemblies may provide a conductive path between the one or more first arcing contacts 220 and one or more first main contacts 225 and a movable assembly load terminal 265. The fixed contact assembly 205 may include one or more second arcing contacts 230 and one or more second main contacts 235 mounted on a fixed assembly load terminal 255. The fixed and movable contact assemblies 205, 210 may be constructed to withstand closing on a fault. Upon closing, the first and second arcing contacts 220, 230 may be configured to contact each other before the first and second main contacts 225, 235.

Circuit breaker 200 may be configured as a single pole circuit breaker with a plurality of sub poles. In this exemplary embodiment, circuit breaker 200 includes two sub poles 240, 245.

Figure 2B:
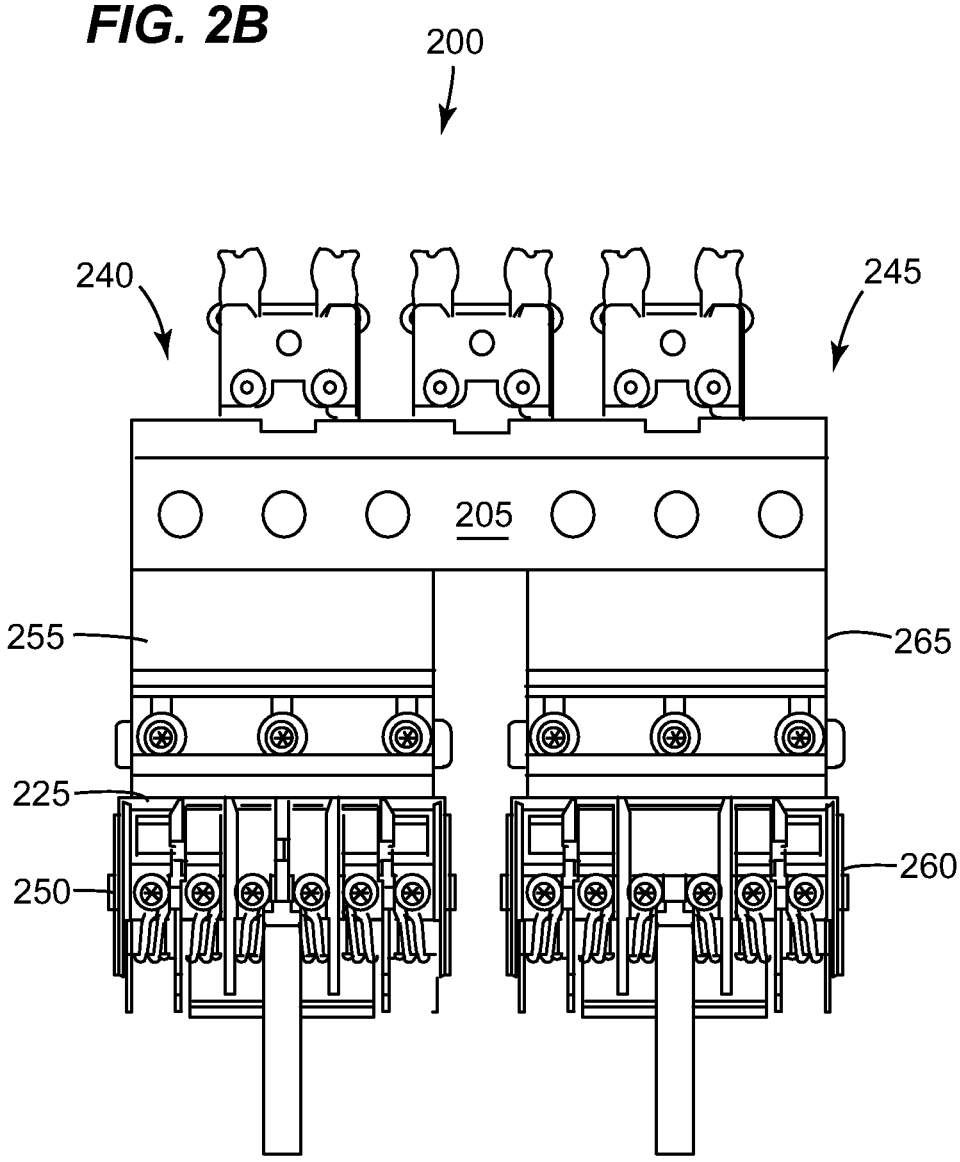
FIG. 2B shows a top view of an exemplary circuit breaker according to the disclosed embodiments.

FIG. 2B shows a top view of exemplary circuit breaker 200. Sub pole 240 may include a movable contact assembly 250 and a fixed contact assembly 255 with its own set of arcing contacts and main contacts as described above. Correspondingly, sub pole 245 may include a movable contact assembly 260 and a fixed contact assembly 265 with its own set of arcing contacts and main contacts. In this embodiment, fixed contact assembly 205 may include fixed contact assembly 255 and fixed contact assembly 265 both of which may be equal sized current carriers. Fixed contact assembly 255 and fixed contact assembly 265 may each have the same number of second arcing contacts 230 and second main contacts 235. Also in this embodiment, movable contact assemblies 250, 260 each may have the same number of first arcing contacts 220 and first main contacts 225.

It should be understood that circuit breaker 200 is not limited to two sub poles and may include one or any suitable number of sub poles. It should also be understood that each sub pole may include any number of fixed contacts and any number of movable contacts mounted on any number of finger assemblies.

Figure 3:
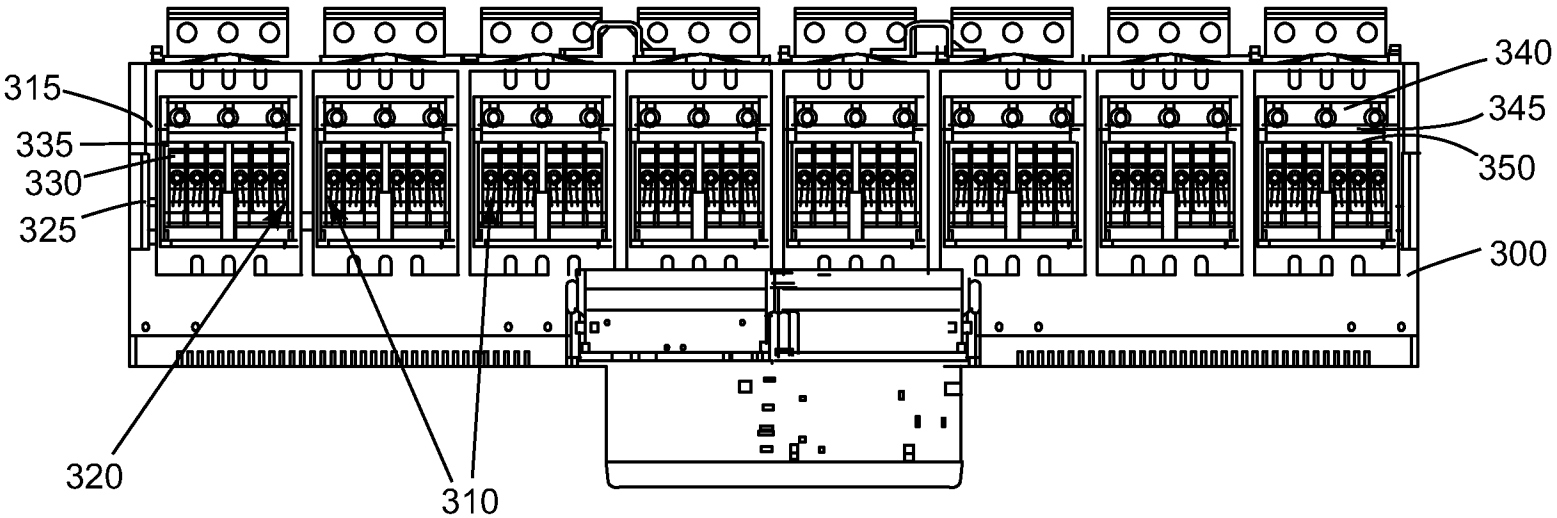
FIG. 3 shows a top view of an exemplary embodiment including one or more sub poles mounted in an enclosure.

FIG. 3 shows a top view of an embodiment that may include one or more sub poles 310 mounted in an enclosure 300. In this embodiment, each sub pole 310 may be installed in an individual chamber 315. At least one wall 320 may be interposed between each sub pole 310 to form the individual chambers 315. In some embodiments the individual chambers may be configured as arc chambers. The arc chambers generally operate to quench arcs which may occur when the first and second arcing contacts 220, 230 mate or separate. The arc chambers 315 may operate to quench any arcs that may occur without adversely circuit breaker operation.

In this embodiment, the sub poles 310 may have a common modular construction and may be interchangeable with each other. Each modular sub pole 310 may include a movable contact assembly 325 with one or more first arcing contacts 330 and one or more first main contacts 335. Each modular sub pole 310 may also include a fixed contact assembly 340 with one or more second arcing contacts 345 and one or more second main contacts 350.

Figure 4:
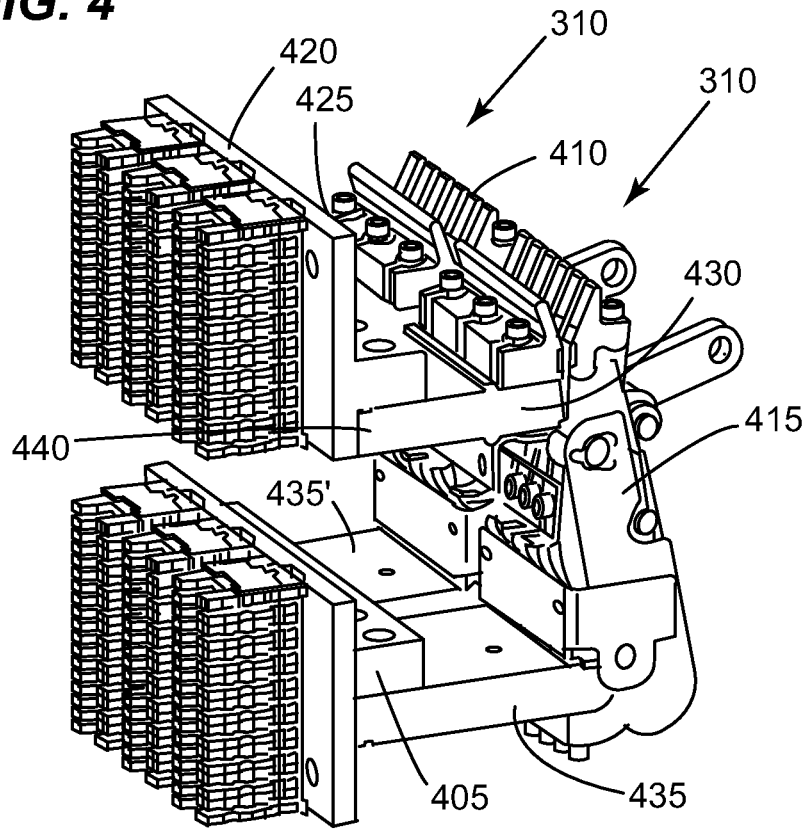
FIG. 4 shows a plurality of exemplary sub poles bridged together.

Turning now to FIG. 4, a plurality of sub poles 310 may be bridged together to form a pole using a conducting member referred to as a cluster pad 405. A cluster pad 405 may be fastened to a plurality of movable assembly load terminals 435, 435' to electrically couple the movable contact assemblies 325. Another cluster pad 420 may be fastened to a plurality of fixed assembly load terminals 440, 440' to electrically couple the fixed assembly load terminals 440, 440'. Cluster pads 405, 420 may also have a modular construction and may be interchangeable.

While FIG. 4 shows two sub poles bridged by each cluster pad, it should be understood that any number of poles may be bridged by a cluster pad.

Figure 5A:
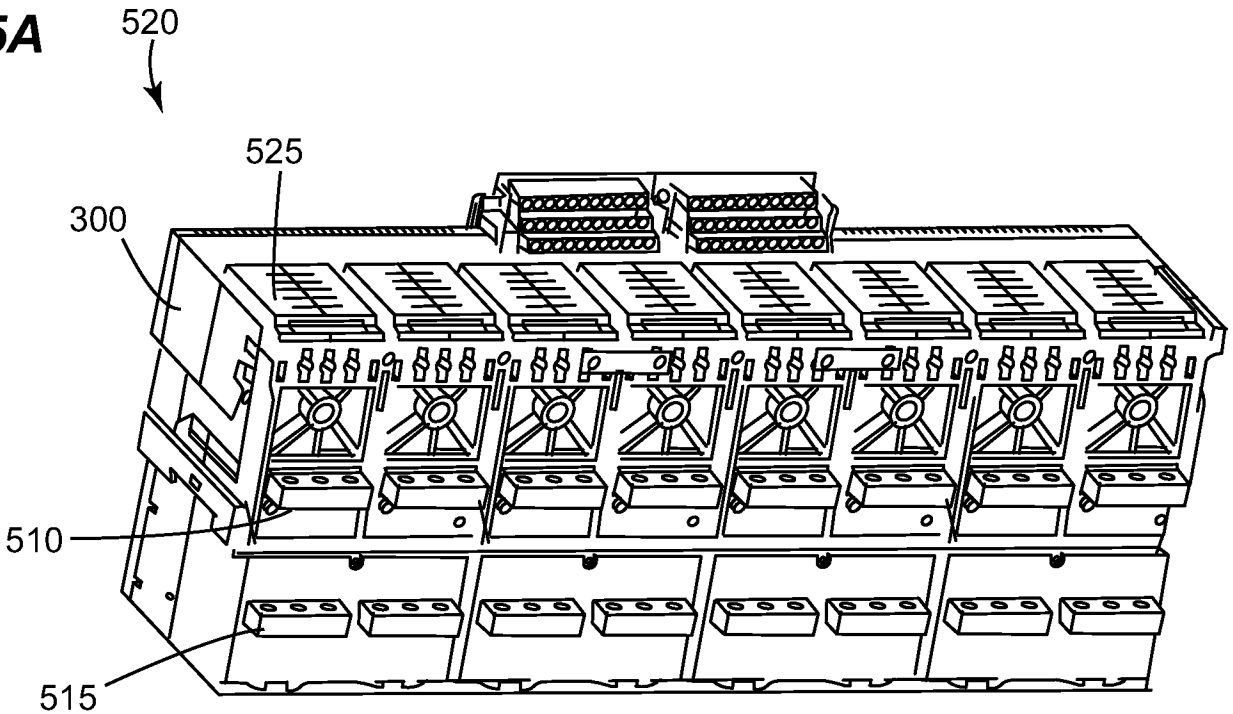
FIG. 5A shows a rear view of an exemplary enclosure in which a number of sub poles are installed.

FIG. 5A shows a rear view of enclosure 300 in which a number of sub poles are installed. Enclosure 300 is constructed so that fixed assembly load terminals 510 and movably assembly load terminals 515 extend through the enclosure. In some embodiments, enclosure 300 may include a number of identical chambers 520. Each chamber 520 may have substantially the same volume within practical manufacturing limits and may enclose an identically constructed sub pole. Each chamber 520 may also have an arc chute assembly 525 that is substantially identical. In alternate embodiments, each chamber may not be identical and may vary in volume. Also, in some embodiments, the enclosures may house at least one sub pole with a different number of finger assemblies. Some embodiments may also include one or more arc chutes with varying dimensions and construction details.

Figure 5B:
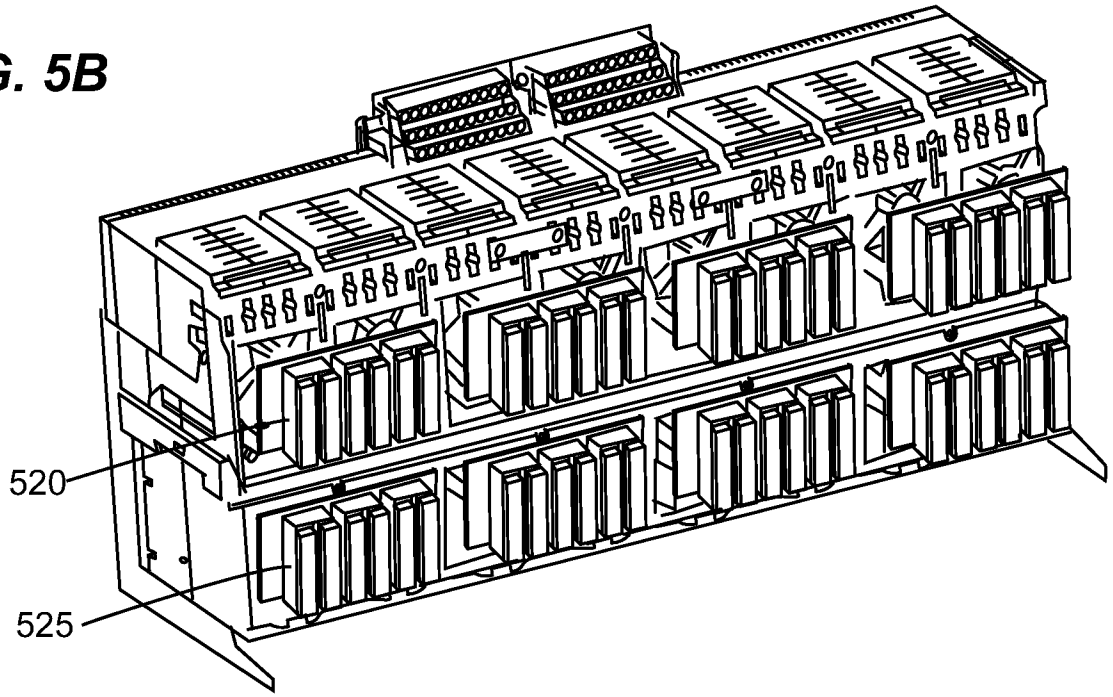
FIG. 5B shows another rear view of the exemplary enclosure.

FIG. 5B shows another rear view of enclosure 300 where a plurality of cluster pads 520 each bridge two fixed assembly load terminals and a plurality of cluster pads 525 each bridge two movable assembly load terminals.

Figure 6:
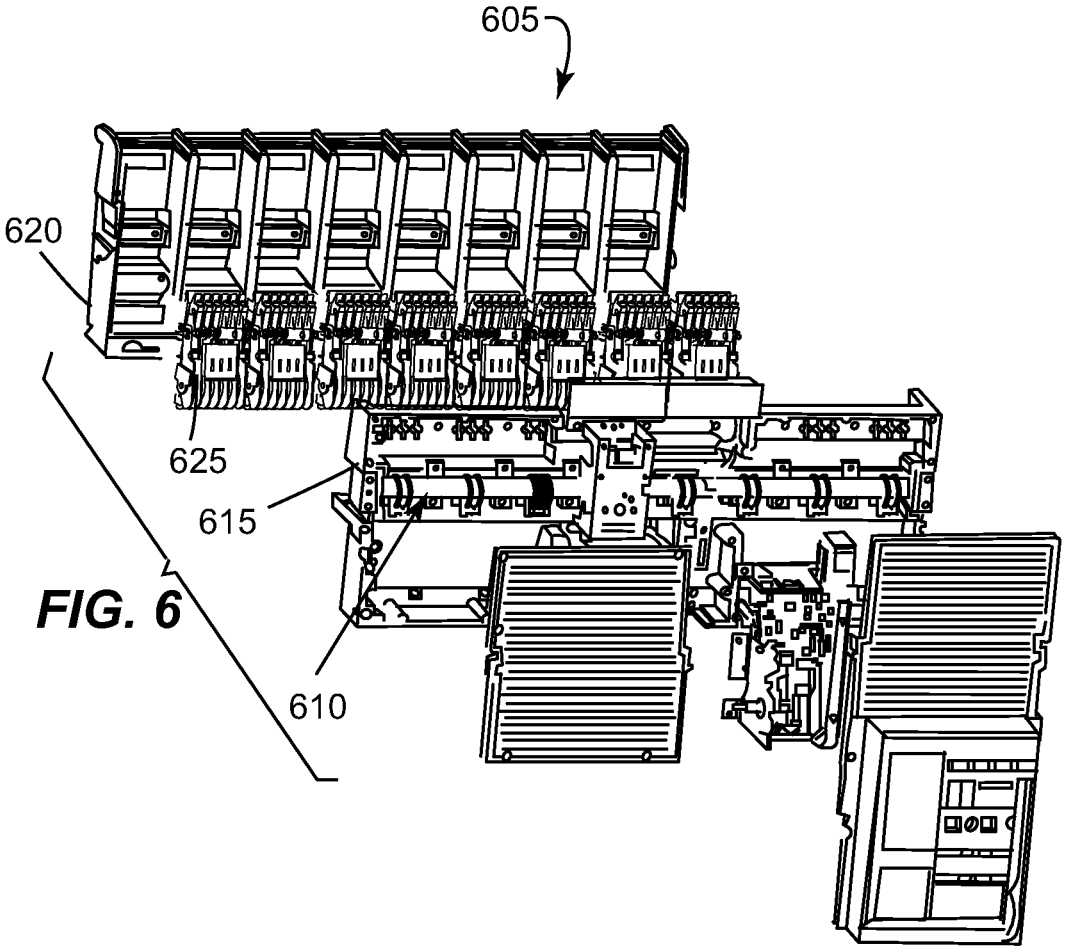
FIG. 6 shows an exploded view of another exemplary enclosure with a common closing shaft.

FIG. 6 shows an exploded view of another exemplary enclosure 605. Enclosure 605 includes a front housing 615 and a rear housing 620. When mated together the front housing 615 and the rear housing 620 form a number of chambers, each enclosing a sub pole circuit breaker 625.

In some embodiments, enclosure 605 chambers may be substantially identical. Each chamber may have substantially the same volume within functional limits and may enclose an identically constructed sub pole. In alternate embodiments, each chamber may not be identical and may vary in volume. Also, in some embodiments, the enclosures may house at least one sub pole with a different number of finger assemblies.

In this embodiment, when the enclosure is assembled the sub poles may be connected to and closed by a common closing shaft 610. Cluster plates (not shown) may bridge one or more sub pole circuit breakers 625.

It should be understood that the foregoing description is only illustrative of the present embodiments. Various alternatives and modifications can be devised by those skilled in the art without departing from the embodiments disclosed herein. Accordingly, the embodiments are intended to embrace all such alternatives, modifications and variances which fall within the scope of the appended claims.

What is claimed is:

1. A circuit breaker apparatus comprising:

an enclosure, comprising a first chamber and a second chamber;

a circuit breaker pole mounted within said enclosure, said circuit breaker pole comprising a first sub pole and a second sub pole, said first sub pole and said second sub pole each comprising a moveable contact assembly and a fixed contact assembly, the moveable contact assembly moveable between a closed position in contact with the fixed contact assembly, and an open position separate from the fixed contact assembly;

said first sub pole moveable contact assembly and said second sub pole moveable contact assembly being conductively bridged together;

said first sub pole fixed contact assembly and said second sub pole fixed contact assembly being conductively bridged together when the moveable contact assembly is in the open position;

wherein said first sub pole is enclosed within said first chamber, and said second sub pole is enclosed within said second chamber;

a first arc chute assembly installed on said first chamber; and a second arc chute assembly installed on said second chamber.

2. The circuit breaker apparatus of claim 1, wherein said first chamber and said second chamber have a substantially equal interior volume.

3. The circuit breaker apparatus of claim 1, wherein said first sub pole and said second sub pole each comprise a modular circuit breaker assembly.

4. The circuit breaker apparatus of claim 1, wherein said first sub pole and said second sub pole each comprise an identical circuit breaker assembly.

5. The circuit breaker apparatus of claim 1, wherein said first chamber and said second chamber each comprise an identical arc chute assembly.

6. The circuit breaker apparatus of claim 1, further comprising one or more conducting members configured to bridge said first sub pole moveable contact assembly and said second sub pole moveable contact assembly; and one or more conducting members configured to bridge said first sub fixed contact assembly and said second sub pole fixed contact assembly.

7. The circuit breaker apparatus of claim 1, wherein the enclosure comprises a front and rear housing configured to form said first chamber and said second chamber when mated together.

8. The circuit breaker apparatus of claim 1, further comprising a common closing shaft coupled to said first sub pole moveable contact assembly and said second sub pole moveable contact assembly.

9. A method comprising:

installing a circuit breaker pole comprising a plurality of sub poles into an enclosure having a plurality of chambers, each one of the plurality of sub poles comprising a moveable contact assembly and a fixed contact assembly, the moveable contact assembly moveable between a closed position in contact with the fixed contact assembly, and open position separate from the fixed contact assembly;

conductively bridging the moveable contact assembly of each sub pole of the plurality of sub poles, and conductively bridging the fixed contact assembly of each sub pole of the plurality of sub poles when the moveable contact assembly is in the open position;

enclosing each sub pole of the plurality of sub poles within an individual chamber of the enclosure; and installing an arc chute on each of the individual chambers enclosing each sub pole the plurality of sub poles.

10. The method of claim 9, further comprising constructing each chamber of the plurality of chambers with a substantially equal interior volume.

11. The method of claim 9, further comprising providing a modular circuit breaker assembly as part of each circuit breaker sub pole.

12. The method of claim 9, further comprising providing an identically constructed circuit breaker assembly as part of each circuit breaker sub pole.

13. The method of claim 9, further comprising providing an identical arc chute assembly for each chamber.

14. The method of claim 9, wherein conductively bridging the moveable contact assembly of each sub pole of the plurality of sub poles comprises using one or more conducting members, and conductively bridging the fixed contact assembly of each sub pole of the plurality of sub poles comprises using one or more conducting members.

15. The method of claim 9, further comprising mating a front and rear housing to form the enclosure.

* * * * *

UNITED STATES PATENT AND TRADEMARK OFFICE

CERTIFICATE OF CORRECTION

PATENT NO. : 8,592,709 B2
APPLICATION NO. : 12/103109
DATED : November 26, 2013
INVENTOR(S) : Newase et al.

It is certified that error appears in the above-identified patent and that said Letters Patent is hereby corrected as shown below:

On the Title Page, in item (75), under "Inventors", in Column 1, Lines 2-3, delete "Andra Pradesh" and insert -- Andhra Pradesh --, therefor.

Signed and Sealed this
Fifteenth Day of April, 2014

Michelle K. Lee

Michelle K. Lee
*Deputy Director of the United States Patent and Trademark Office*